United States Patent [19]

Tate

[11] Patent Number: 4,991,996

[45] Date of Patent: Feb. 12, 1991

[54] WORK ENCLOSURE FOR SERVICING MARINE STRUCTURES

[75] Inventor: Steven H. Tate, Morgan City, La.

[73] Assignee: Mobil Oil Corporation, Fairfax, Va.

[21] Appl. No.: 444,029

[22] Filed: Nov. 30, 1989

[51] Int. Cl.[5] ..... B63C 11/00

[52] U.S. Cl. ..... 405/14; 405/11; 405/12; 182/187

[58] Field of Search ..... 405/11-14, 405/188, 211, 216; 182/187

[56] References Cited

U.S. PATENT DOCUMENTS

| | | | |
|---|---|---|---|
| 3,197,968 | 8/1965 | Castellanos | 405/11 |
| 3,331,211 | 7/1967 | Cravens et al. | 405/12 |
| 3,768,265 | 10/1973 | Brouillette | 405/12 |
| 3,871,181 | 3/1975 | DeLong | 405/11 |

FOREIGN PATENT DOCUMENTS

| | | | |
|---|---|---|---|
| 13615 | 1/1987 | Japan | 405/11 |
| 2114636 | 8/1983 | United Kingdom | 405/11 |

*Primary Examiner*—Randolph A. Reese
*Assistant Examiner*—John A. Ricci
*Attorney, Agent, or Firm*—Alexander J. McKillop; Charles J. Speciale; George W. Hager, Jr.

[57] ABSTRACT

A work enclosure for servicing a marine structure which is adapted to be positioned around a support member of the marine structure to enclose the member and at least one riser which extends parallel thereto. The enclosure is watertight and open at the top to the atmosphere whereby the water is pumped from the enclosure when the enclosure is in an operable position on the member to provide a dry, shirt-sleeve environment in which to carry out the service operations.

13 Claims, 5 Drawing Sheets

FIG. 6
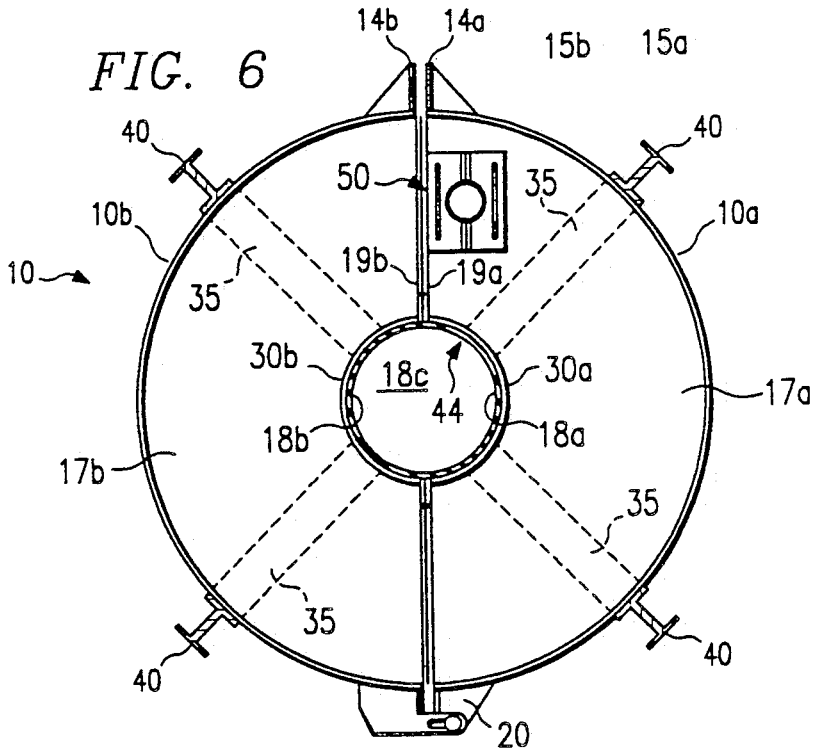
FIG. 8
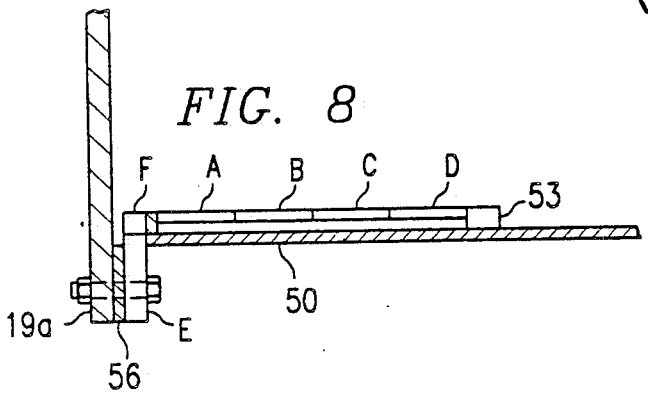
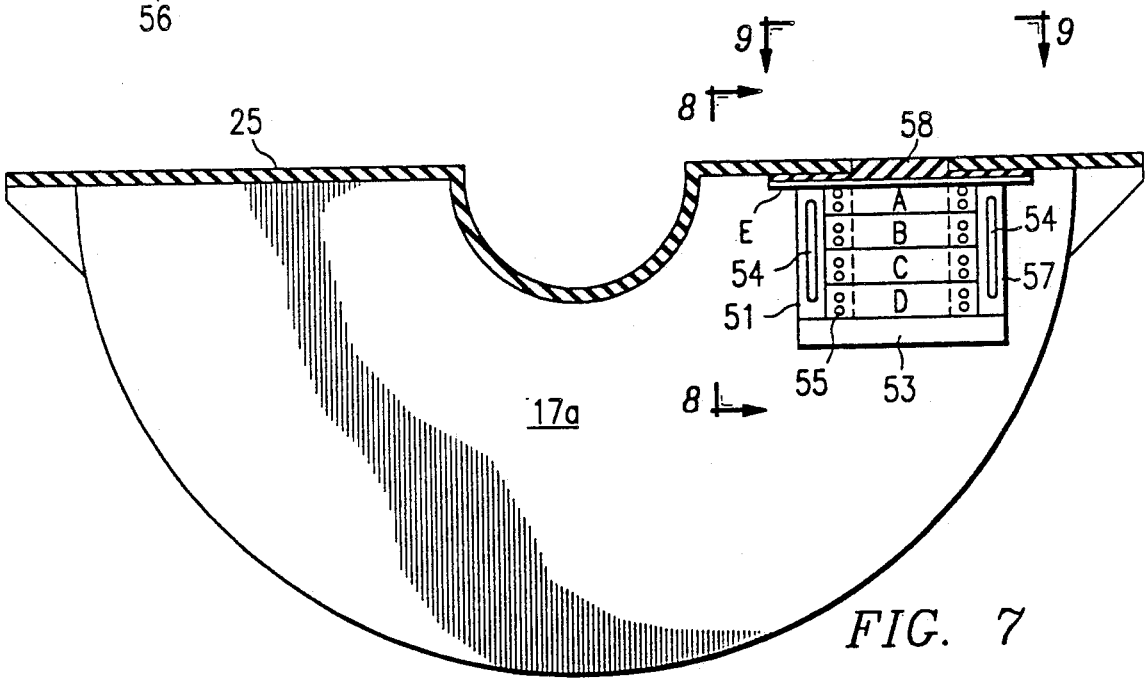
FIG. 7

FIG. 9
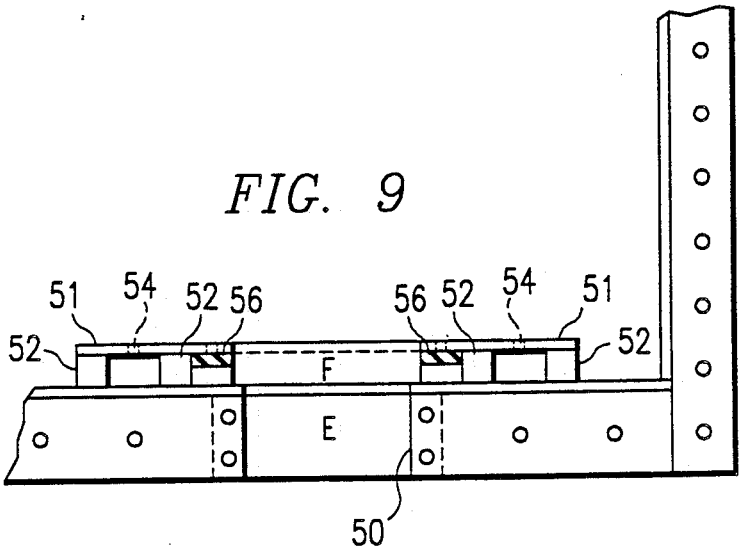
FIG. 10
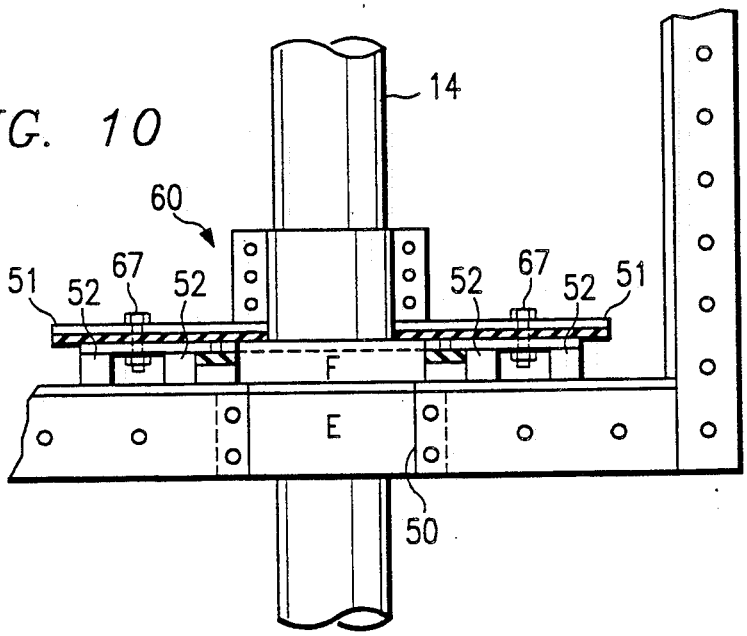
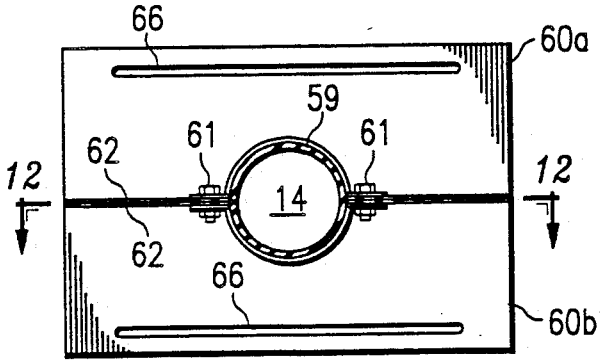
FIG. 11
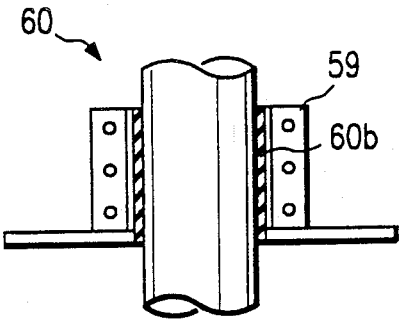
FIG. 12

WORK ENCLOSURE FOR SERVICING MARINE STRUCTURES

TECHNICAL FIELD

The present invention relates to a work enclosure for servicing marine structures and in one of its preferred aspects relates to a reusable, watertight, work enclosure which is open to the atmosphere and which is adapted to be removably positioned around a support member of a marine structure after which the water is removed therefrom to provide a shirt-sleeve environment for the service personnel.

BACKGROUND ART

Bottom-supported marine structures are commonly installed at offshore locations for a variety of reasons, e.g. the drilling and production of hydrocarbons. Typically, one or support members (e.g. legs or piles) are embedded in the marine bottom and extend to above the water surface to support a drilling and/or production platform. It is also common to run flowlines, control lines, etc. (collectively called "risers") from the marine bottom to the surface along these support members. As is well known in the industry, these support members and the risers are subject to damage due to corrosion, erosion, collisions, etc. and are likely to require repair and/or replacement from time to time. This is especially true of those portions of the support members and risers which extend through the "splash zone", i.e. the zone of water at or near the surface which experiences the forces generated by the action of the waves.

The repair of these elements, especially in the splash zone, have proven costly due to the specially trained personnel and the excessive time normally required to perform the work. That is, often highly trained divers are required to work for long periods to carry out what would otherwise be a fairly routine operation. In other instances, a "cofferdam" or "habitat" has to be installed around the support member and riser to provide the proper environment for the personnel to work in.

As known in the art, a "cofferdam" is a watertight enclosure which is normally formed of sheet piles which are driven into the marine bottom and extend to above the water's surface. The sheets are connected to form a watertight enclosure around the support member and/or risers and is open to the atmosphere at its top. After the water is pumped out of the cofferdam, personnel can enter the enclosure and work in a relatively "dry" environment. While cofferdams provide a good work area, they are only practical in relatively shallow depths and they must be constructed and dismantled in their entirety each time they are used. Obviously, this is very expensive and time consuming.

"Habitats" are work enclosures which are not exposed to the atmosphere but instead are completely enclosed structures which are used below the surface. They usually consist of two sections which are bolted together and sealed around a member to be serviced. Once sealed, the habitat is pumped out and pressurized depending on the depth installed. The work performed in a habitat is carried out with divers with entrance being directly through the water or from a diving bell. Habitats are normally specifically designed for a particular application. Sometimes, however they can be reused but only after they undergo major fabrication modifications. Again, the use of these types of work enclosures, especially in the splash zone, is extremely expensive and time consuming.

Accordingly, a real need exists for a work enclosure which can be used over and over again with little or no modification and one which can be quickly installed and removed from a marine support member to provide a "dry" work area for personnel in the splash zone.

DISCLOSURE OF THE INVENTION

The present invention provides a re-usable, watertight work enclosure which is open at the top to the atmosphere and which can easily be installed and removed in the splash zone around a support member of a marine structure and any risers lying adjacent thereto. The work enclosure is comprised of at least two sections which, when an open position, are positioned around the member and riser. The sections are moved to a closed position and then releasably secured together with bolts or the like to form a work enclosure around the member and riser. Water is pumped from the enclosure to provide a "shirt-sleeve" environment for the work personnel.

More specifically, the work enclosure of the present invention is formed of two, substantially symmetrical sections which are preferably hinged together whereby they can be rotated with respect to each other between an open and a closed position. One or more hydraulically-operated pistons are connected between the sections to aid in moving the sections between the open and closed positions. Each section is open at the top and has a bottom plate which effectively closes the bottom thereof. Each bottom plate has an opening therethrough which cooperate together to form a central opening which, in turn, is adapted to receive and surround the support member when the sections are in a closed position.

The sections are releasably secured together in the closed position by bolts or the like. Gaskets are provided between the mating surfaces of the sections to prevent flow therebetween. Clamp means, which are formed in sections, are affixed to the enclosure sections, respectively, and are aligned with central opening through the bottom plates for engaging the support member to secure the enclosure thereon.

At least one of the bottom plates also includes a riser opening therethrough which, in turn, is adapted to receive at least one riser as the enclosure sections are moved to the closed position around the support member. The riser is secured within the riser opening by means of a riser clamp which is first positioned around and secured to the riser before the clamp is secured to the bottom plate. A gasket is positioned between the riser and the riser clamp to prevent flow between the two.

After the enclosure is installed and the riser has been captured, the water is pumped from the enclosure to provide a relatively dry, shirt-sleeve environment in which personnel can carry out the desired maintenance or repair operations. Once these operations have been completed, the enclosure can be removed for reuse in other operations. A flood valve is provided on one of the sections through which the enclosure can be flooded with seawater in the event the enclosure has to be temporarily abandoned during operations.

BRIEF DESCRIPTION OF THE DRAWINGS

The actual operation and the apparent advantages of the present invention will be better understood by referring to the drawings in which like numerals identify like parts and in which:

FIG. 6 is a sectional view taken along line 6—6 of FIG. 2;

FIG. 7 is the bottom of one section of the present work enclosure, similar to FIG. 6 but enlarged;

FIG. 8 is a sectional view taken along line 8—8 of FIG. 7;

FIG. 9 is a sectional view taken along line 9—9 of FIG. 7;

FIG. 10 is a sectional view similar to FIG. 9 with a riser in place;

FIG. 11 is plan view, partly in section, of the riser clamp of the present invention; and FIG. 12 is a sectional view taken along line 12—12 of FIG. 11.

BEST MODE FOR CARRYING OUT THE INVENTION

Figure 1:
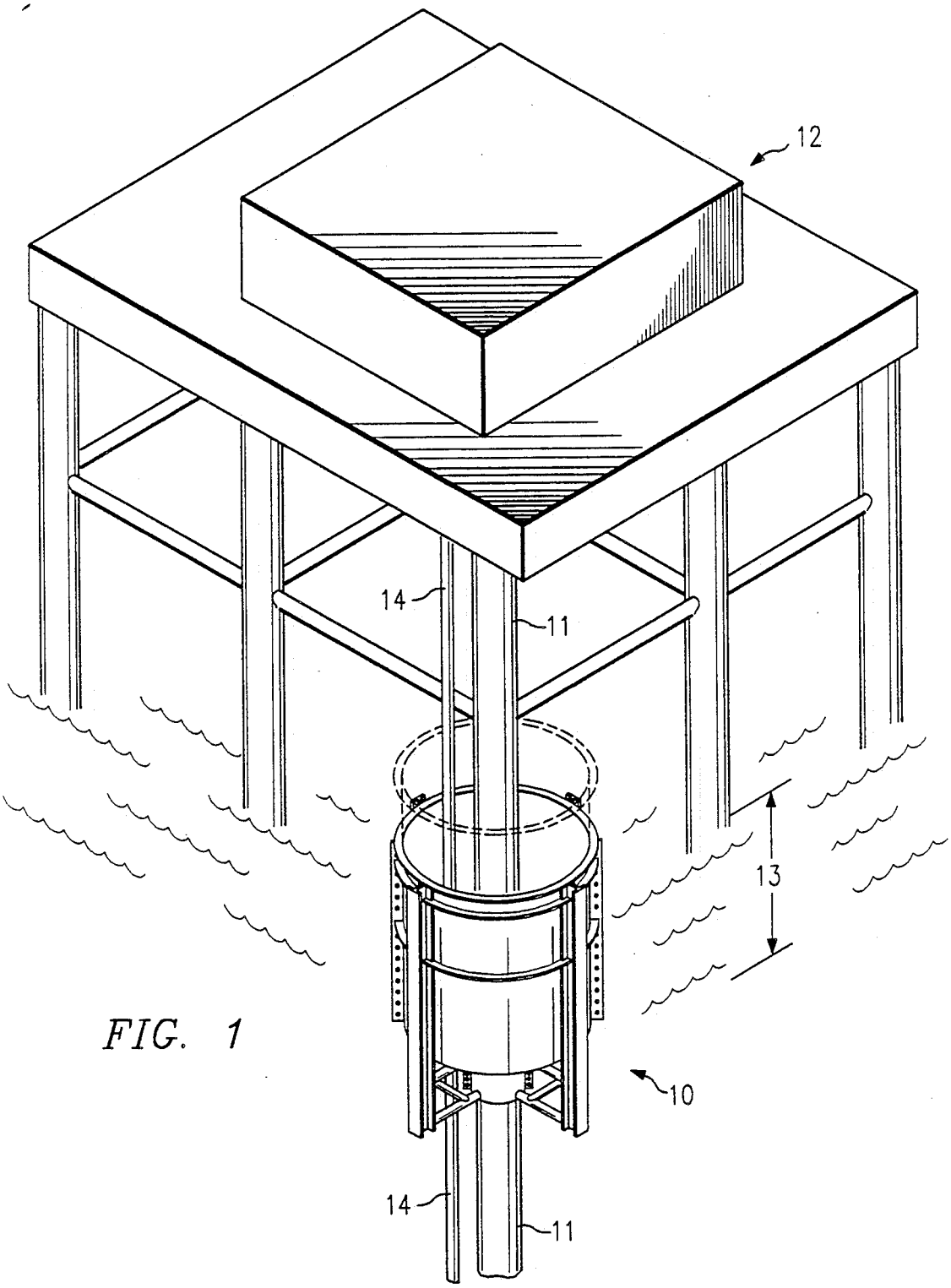
FIG. 1 is a perspective view of the present work enclosure in an operable position on a support member of a marine structure.

Referring more particularly to the drawings, FIG. 1 discloses the enclosure 10 of the present invention installed in an operable position on a support member 11 of a marine structure, e.g. a bottom-supported platform 12. As used herein, "Support member" shall mean any support for a marine structure which extends upwardly through the "splash zone" of a body of water to a point above the surface, e.g. bottom-supported piles, legs of prefabricated structures, etc. As will be understood, the "splash zone" is that zone of a body of water at or near the surface which is subject the forces generated by the wave action which, in turn, can cause severe damage to the structural elements lying within that zone. As illustrated, enclosure 10 is installed on the leg 11 of platform 12 in splash zone 13 and is in position to service member 11 and/or riser 14. As understood in the art, "riser" as used herein shall mean any flowline, control line, etc. which extends through the water and run along and lies substantially parallel to member 11.

Turning now to the other figures, work enclosure 10 is comprised of a housing which is formed of at least two sections which, in turn, can be positioned around support member 11 when in an open position and then closed and secured together to form a watertight enclosure from which the water can be pumped to provide a relatively dry work environment. As preferred and shown, enclosure 10 is comprised of two, substantially symmetrical section 10*a*, 10*b*; each of which is semi-cylindrical in configuration. The sections are formed of any material, e.g. ¾ inch steel plating, which is capable of withstanding the forces in the splash zone 13. Welded or otherwise secured to each section 10*a*, 10*b* are bottom plates 17*a*, 17*b*, respectively, each having an opening 18*a*, 18*b* therethrough. As illustrated, each opening 18*a*, 18*b* is semi-circular whereby the openings cooperate with each other when the sections are in a closed position to form a central opening 18*c* which, in turn, is adapted to receive cylindrical-shaped, support member 11. It should be recognized, however, that openings 18*a*, 18*b* may be differently shaped, e.g. rectangular, if enclosure 10 is designed for use with other shaped members 11, rectangular support member, etc.

Each section 10*a*, 10*b* has a front flange 14*a*, 14*b*, respectively, and a back flange 15*a*, 15*b*, respectively, affixed thereto and extending along the outer front and back surfaces of each section. Also, each section 10*a*, 10*b* has a bottom flange 19*a*, 19*b*, respectively, running along the under surface of bottom plates 17*a*, 17*b*.

Figure 2:
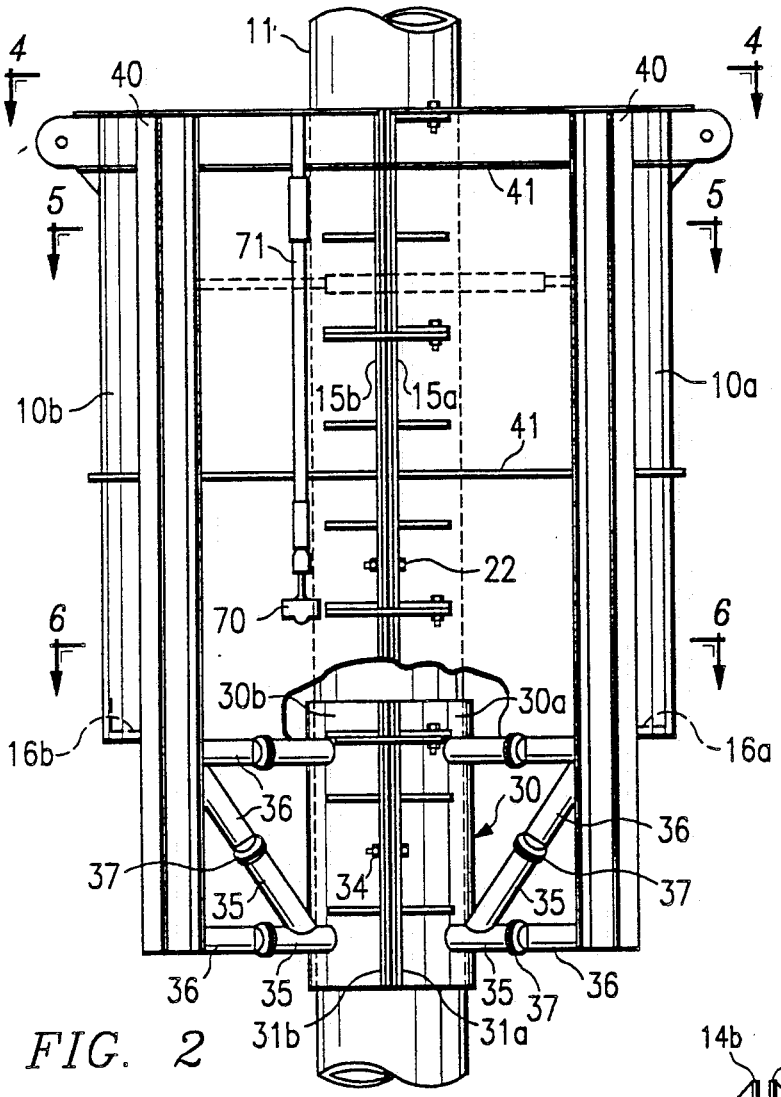
FIG. 2 is an elevational view of the present work enclosure.
Figure 4:
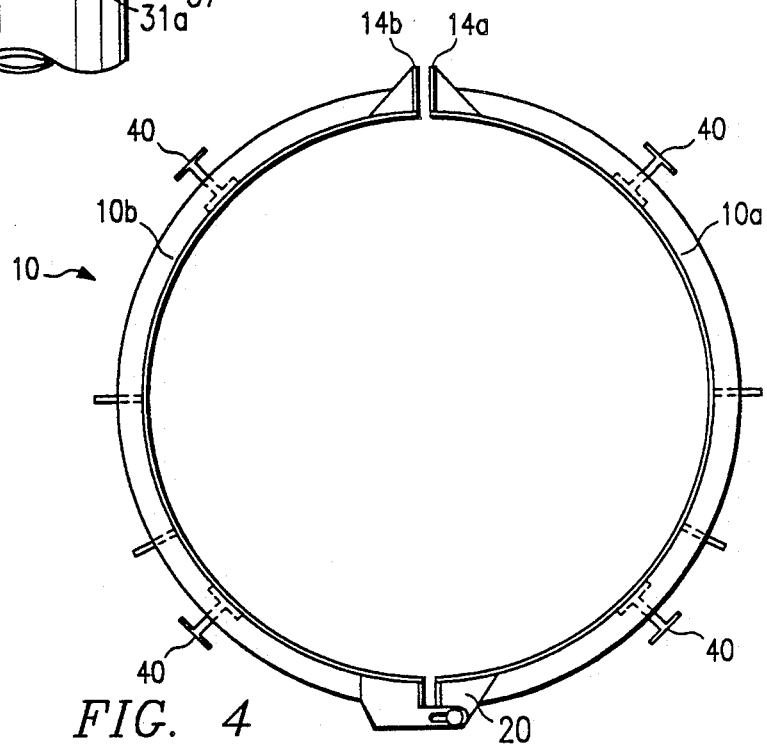
FIG. 4 is a sectional view taken along line 4—4 of FIG. 2.
Figure 3:
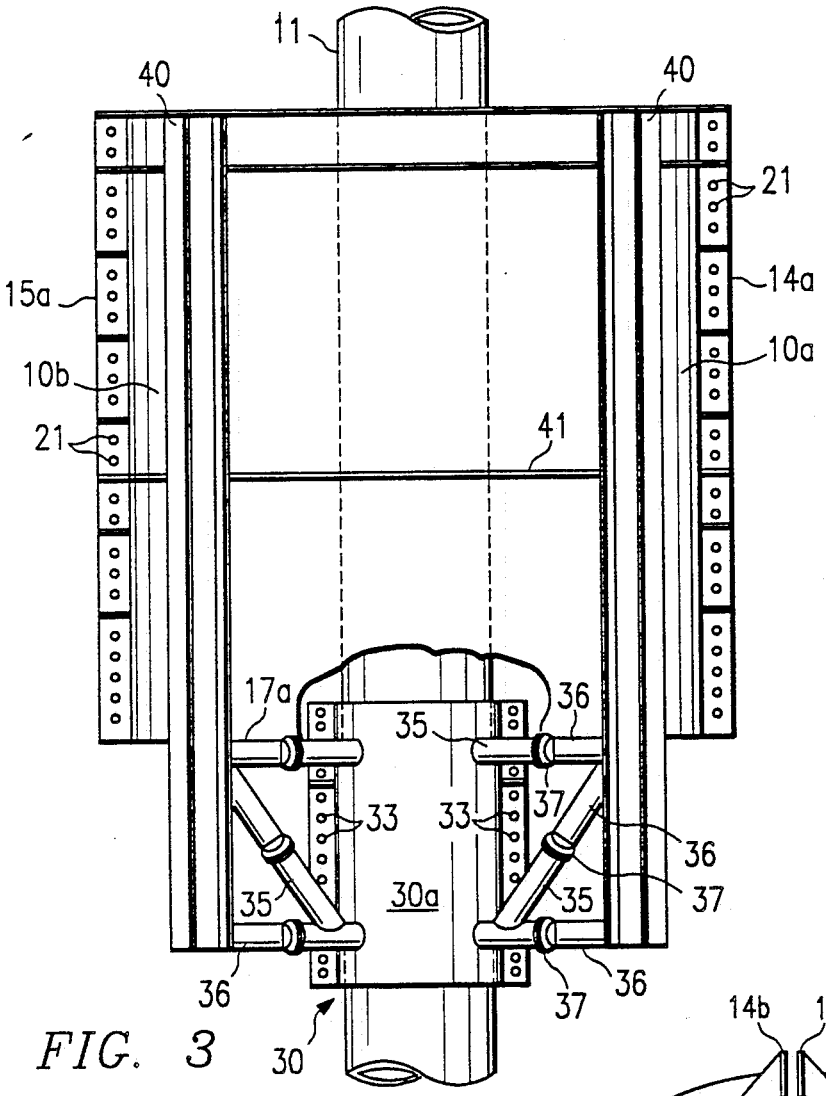
FIG. 3 is an elevational view of the work enclosure of FIG. 1 but rotated 90°.

Preferably, back flanges 15*a*, 15*b* are rotatably connected to each other by one or more spaced hinges 20 (see FIGS. 4 and 6) whereby sections 10*a*, 10*b* can be rotated with respect to each other between an open position in which the sections can be placed around member 11 and a closed position in which the sections completely surround and enclose the member. Flanges 14*a*, 14*b*, and 15*a*, 15*b*, and 19*a*, 19*b*; all have a plurality of holes 21 (only some of which are numbered in the figures) spaced along their respective lengths and which align with holes on a respective flange when the sections are in a closed position to receive bolts 22 (only one shown in FIG. 2) to releasably secure the sections 10*a*, 10*b* together in the closed position.

To provide a watertight seal between the respective flanges when the two sections 10 *a*, 10*b* are moved to a closed position, gaskets 25 (only shown in FIG. 7) are provided between the flanges. Preferably, each gasket is comprised of a sheet of elastic material, e.g. neopreme rubber, which is vulcanized or otherwise secured to the inner surface of each flange. Each of the gaskets have a plurality of holes which are aligned with the holes 21 in the respective flanges whereby bolts 22 can pass therethrough when the sections are secured in a closed position. The gaskets will respectively engage each other when the sections are closed to effect a watertight seal between the flanges.

Figure 5:
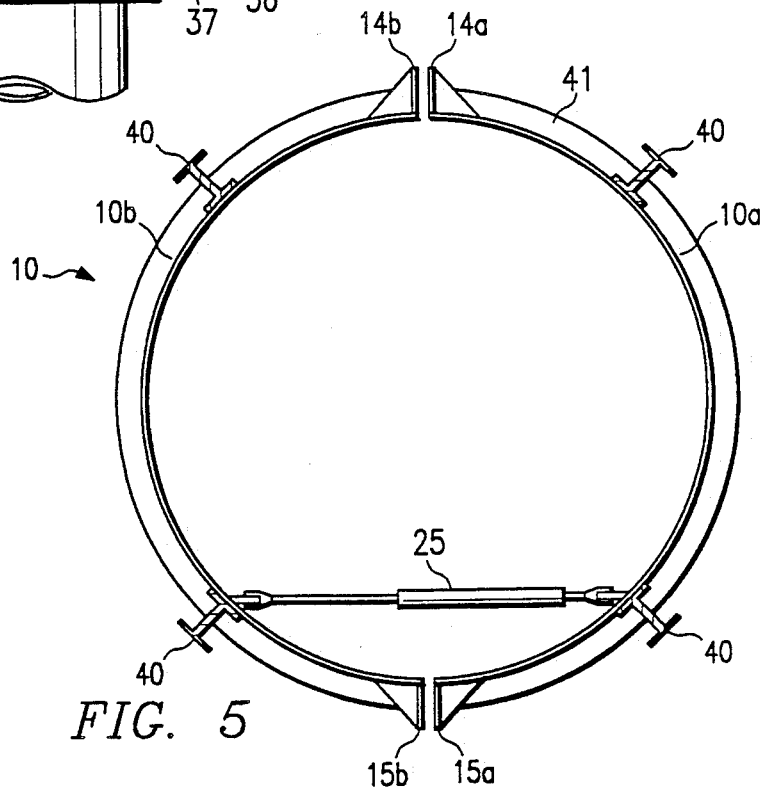
FIG. 5 is a sectional view taken along line 5—5 of FIG. 2.

Preferably, one or more hydraulic piston means 25 (FIG. 5) are connected between sections 10*a*, 10*b* to (1) aid in closing the heavy sections (2) compress the gaskets to effect a good seal therebetween, and (3) hold the sections together while bolts 22 are being installed.

Affixed within opening 18*c* in bottom plates 17*a*, 17*b* is support clamp means 30 which secures enclosure to support member 11 when the sections 10*a*, 10*b* are in a closed position. Support clamp means 30 is comprised of two symmetrical clamp sections 30*a*, 30*b* which, when closed, will have an internal configuration, e.g. cylindrical, adapted to receive and enclose support member 11. Clamp sections 30*a* 30*b* are positioned and affixed by welding or the like in openings 18*a*, 18*b*, respectively, of bottom plates 17*a*, 17*b* and have front flanges 31*a*, 31*b* and back flanges 32*a*, 32*b* which, in turn, have aligned holes 33 therein to receive bolts 34 (only one shown in FIG. 2) to secure clamp sections together when in a closed position.

Clamp sections 30*a*, 30*b* are further affixed to sections 10*a*, 10*b*, respectively, by means of struts 35 which are preferably releasably secured to struts at flanges 37 by bolts (not shown). Struts 36 are mounted on and extend from elongated elements e.g. I-beams 40, which, in turn, extend from and are affixed to the exterior surfaces of section 10*a*, 10*b*, respectively, and which along with stiffener rings 41 serve to reinforce sections 10*a*, 10*b*. A gasket 44 (FIG. 6) of elastic material, e.g. neopreme rubber, is vulcanized or otherwise secured onto the inner surfaces of clamp 30 to provide a seal between the clamp means and support member 11 when enclosure is in a closed position to prevent flow through opening 18 into the enclosure.

While work enclosure 10, as described up to this point, can be used to repair member 11 in splash zone 13, routinely there is also a need to repair or service a riser, e.g. flowline 14, which lies adjacent the support member. To effect such a repair from the present enclosure, at least one of the bottom plates, e.g. 17*a*, is provided with a riser opening 50.

Riser opening 50 opens through the side of bottom plate 17*a* and through bottom flange 19*a* which runs there along whereby riser 14 can easily enter opening 50 as sections 10*a*, 10*b* begin to close around member 11. Positioned and affixed on either side of opening 50 are brackets 51 which are spaced from and secured to bottom plate 17*a* by stand-offs 52. A stand-off 53 extends between stand-offs 52 along the back edge of opening 50. Each bracket 51 has a slot 54 therethrough for a purpose described later.

To keep enclosure 10 watertight when no riser 14 is in opening 50, riser opening 50 is initially sealed by one or more plates A, B, C, D, which are releasably held in place by screws 55 or the like. By providing a plurality of plates, only those necessary for a particular-sized riser need be removed. Each plate is sealed by a respective gasket 56 to prevent flow of water into the enclosure. Also, vertical plates E and F cover the opening through the bottom flange 17*a* and the edge of the bottom plate 17*a*, respectively, and both have a gasket 58 vulcanized or bonded thereto which cooperate with the gaskets on the bottom flange 19*a* of section 10*b* to insure a watertight seal between the sections 10*a*, 10*b* when they are in a closed position.

When a riser 14 is to be captured for repair, the necessary plates A, B, C or D and plates E and F are removed and riser 14 is moved into riser opening 50 as sections 10*a*, 10*b* are closed around member 11. Gasket 59, i.e. a cylinder of neopreme rubber, is split at one point so it can be positioned completely around riser 14 (see FIGS. 11 and 12). Riser clamp 60, which is formed in two sections 60*a*, 60*b*, is positioned over gasket 59 and secured together with bolts 61 (FIG. 11). Gaskets 62 are vulcanized or otherwise secured onto the surfaces of the flanges of riser clamp sections to provide a seal therebetween.

Once riser clamp 60 is in place on riser 14, clamp 60 is secured to brackets 51 adjacent riser opening 50. Riser clamp 60 has two elongated slots 66 (FIG. 11) therein which cooperate with slots 54 in brackets 51 to receive bolts 67 (FIG. 10) or the like to secure the clamp, and hence riser 14, over opening 50. Plates E and F are replaced in their original positions as are any of the plates A, B, C, or D which can be replaced, depending on the size of the riser 14.

The sections 10*a*, 10*b* are then completely closed and secured. The water which is trapped within enclosure 10 is removed by pumping or the like, thereby providing a substantially dry, atmospheric shirt-sleeve environment for carrying out the repair work. A valve 70 (FIG. 2) is provided on section 10*a* which can be opened by the extended handle 71 so enclosure 10 can be flooded with water if it becomes necessary to temporarily abandon structure 12 due to hostile conditions (e.g., hurricane) while repair operations are being carried out from the enclosure. By flooding the enclosure, the likelihood that it may be collapsed or otherwise damage by the hostile conditions is reduced.

What is claimed is:

1. A work enclosure adapted to be positioned about marine support member, said enclosure comprising:

at least two sections, each section being open at the top and having a bottom which has an opening therethrough;

means for securing said sections together in a watertight, closed position around said support member whereby said openings in said bottoms of said sections cooperate to form a central opening through said bottom which surrounds said support member; and clamp means for securing said enclosure to said support member when said sections are in a closed position and wherein said bottom of at least one of said sections includes a riser opening therethrough adapted to receive at least one riser when said enclosure is in said closed position.

2. The work enclosure of claim 1, including:

hinge means for rotatably connecting said sections whereby said sections can be moved between an open position and a closed position.

3. The work enclosure of claim 2, including:

means for moving said sections between said open and closed positions.

4. The work enclosure of claim 3, wherein said means for moving said sections comprises:

at least one hydraulically-actuated piston connected between said sections.

5. The work enclosure of claim 1, including:

means for sealing between said at least one riser and said riser opening.

6. The work enclosure of claim 5, including:

hinge means for rotatably connecting said sections whereby said sections can be moved between an open position and a closed position.

7. A watertight, work enclosure adapted to be positioned about a support member which extends upward from a body of water, said enclosure comprising:

two substantially symmetrical sections, each section being open at the top thereof and each having a bottom which has an opening therethrough;

hinge means for rotatably connecting said sections whereby said sections can be moved between an open position and a closed position;

means for releasably securing said sections in said closed position whereby said openings in said bottoms cooperate to form a central opening which surrounds said support member; and clamp means affixed to said sections for securing said enclosure to said support means when said sections are secured in said closed position; and wherein said bottom of at least one of said two sections has a riser opening therethrough adapted to receive at least one riser when said enclosure is in said closed position.

8. The work enclosure of claim 7, including:

means for sealing between said central opening and said support member when said enclosure is in said closed position to prevent flow through said central opening.

9. The work enclosure of claim 7, including:

means for sealing between said at least one riser and said riser opening when said riser is received in said riser opening to prevent flow through said riser opening.

10. The work enclosure of claim 9, including:

means for flooding said enclosure with water when said enclosure is in a closed position.

11. The work enclosure of claim 9, wherein said clamp means comprises:

two substantially symmetrical sections, said clamp sections being affixed to said enclosure sections, respectively, and aligned with said openings in said bottoms whereby said clamp sections will surround and engage said support member when said enclosure is in said closed position.

12. The work enclosure of claim 11, wherein said means for sealing between said central opening and said support member comprises:

elastic material affixed to each of said clamp sections and adapted to engage said support member in a sealing relationship when said enclosure is in a closed position.

13. The work enclosure of claim 12, wherein said means for sealing between said at least one riser and said riser opening comprises:

a riser clamp comprising:

two symmetrical riser clamp sections;

means to secure said riser clamp sections around said riser;

means for sealing between said riser clamp and said riser; and means for securing said riser clamp to said riser clamp opening.

* * * * *